US008408757B2

(12) United States Patent
Woo et al.

(10) Patent No.: US 8,408,757 B2
(45) Date of Patent: Apr. 2, 2013

(54) RECESSED LIGHTING APPARATUS AND COVER THEREFOR

(75) Inventors: Yun Seok Woo, Gyunggi-do (KR); Hyeong Won Yun, Gyunggi-do (KR); Min Soo Han, Gyunggi-do (KR)

(73) Assignee: Samsung Electronics Co., Ltd., Seoul (KR)

( * ) Notice: Subject to any disclaimer, the term of this patent is extended or adjusted under 35 U.S.C. 154(b) by 0 days.

(21) Appl. No.: 13/297,722

(22) Filed: Nov. 16, 2011

(65) Prior Publication Data

US 2012/0127735 A1 May 24, 2012

(30) Foreign Application Priority Data

Nov. 24, 2010 (KR) ..... 10-2010-0117750

(51) Int. Cl.
*F21V 15/01* (2006.01)

(52) U.S. Cl. ..... 362/364; 362/148

(58) Field of Classification Search ..... 362/364, 362/148, 147, 368, 374, 367, 375, 612, 613
See application file for complete search history.

(56) References Cited

U.S. PATENT DOCUMENTS

| | | | | |
|---|---|---|---|---|
| 4,490,957 | A | 1/1985 | Bumpus et al. | |
| 7,481,550 | B1 | 1/2009 | Schreiber et al. | |
| 2005/0286256 | A1 * | 12/2005 | Tran et al. | 362/404 |

FOREIGN PATENT DOCUMENTS

| | | | |
|---|---|---|---|
| EP | 2 166 280 | A1 | 3/2010 |
| KR | 10-2009-0013911 | A | 2/2009 |
| KR | 10-2010-0031970 | A | 3/2010 |
| KR | 10-2010-0060846 | A | 6/2010 |
| WO | WO 02/44614 | A1 | 6/2002 |

OTHER PUBLICATIONS

Extended European Search Report issued in European Patent Application No. 11190557.6-2423, dated Feb. 21, 2012.

* cited by examiner

*Primary Examiner* — Anh Mai
*Assistant Examiner* — Elmito Breval
(74) *Attorney, Agent, or Firm* — McDermott Will & Emery LLP

(57) ABSTRACT

Provided is a cover for a recessed lighting apparatus, including: a plurality of profiles, each including a first insertion groove having a coupling member inserted thereinto, a second insertion groove connected to the first insertion groove and formed to have a screw inserted thereinto, and a holding plate formed to have a diffuser plate stably mounted thereon; and an L-shaped coupling member including a body part and a wing part configured to be connected to the body part, inserted into the first insertion groove to be combined with a profile adjacent thereto using a screw, and a lever configured to be separable from a recessed metal housing formed to receive a lighting device therein, the plurality of profiles and the L-shaped coupling member being configured to receive the diffuser plate therein and configured to be separable from the metal housing.

9 Claims, 4 Drawing Sheets

RECESSED LIGHTING APPARATUS AND COVER THEREFOR

CROSS-REFERENCE TO RELATED APPLICATIONS

This application claims the priority of Korean Patent Application No. 10-2010-0117750 filed on Nov. 24, 2010, in the Korean Intellectual Property Office, the disclosure of which is incorporated herein by reference.

BACKGROUND OF THE INVENTION

1. Field of the Invention

The present invention relates to a lighting apparatus and a cover therefor, and more particularly, to a recessed-type lighting apparatus installed in a ceiling or a wall surface.

2. Description of the Related Art

A method of installing a lighting apparatus according to a related art, in which a metal housing including a lighting apparatus is fastened to a ceiling profile (structural member?) by using screws and a cover is then fastened to the housing screws, has commonly been used in the art. However, this conventional method may have shortcomings, in which fastening portions thereof may be seen from the outside and abrasion in screw fastening portions may occur due to frequent attachment and detachment operations, and further, in which a breakdown of a diffuser plate or the like may occur due to the breakaway thereof and carelessness in the treatment thereof by a user in the case of an assembly having a simple structure in which the diffuser plate is merely seated in an inner portion of the cover.

SUMMARY OF INVENTION

An aspect of the present invention provides a cover for a recessed lighting apparatus having an excellent combinational force with a metal housing in order to reduce danger in the case that a lighting apparatus falls from the cover thereof, in which an attachment thereof to, or a detachment from, the metal housing is easy and the size thereof may be facilitated to be controlled depending on the size of the metal housing and in which a diffuser plate can be stably fixed.

According to an aspect of the present invention, there is provided a cover for a recessed lighting apparatus including: a plurality of profiles, each including a first insertion groove having a coupling member inserted thereinto, a second insertion groove connected to the first insertion groove and formed to have a screw inserted thereinto, and a holding plate formed to have a diffuser plate stably mounted thereon; and an L-shaped coupling member including a body part and a wing part configured to be connected to the body part, inserted into the first insertion groove to be combined with a profile adjacent thereto using a screw, and a lever configured to be separable from a recessed metal housing formed to receive a lighting device therein, the plurality of profiles and the L-shaped coupling member being configured to receive the diffuser plate therein and configured to be separable from the metal housing.

The profile may include a holding jaw to which the diffuser plate is fixed.

The L-shaped coupling member may include a holding jaw to which the diffuser plate is fixed, and a groove into which a magnet is inserted.

The cover for a recessed lighting apparatus may further include a straight-type coupling member connecting profiles forming a common side of the cover for a recessed lighting apparatus.

The straight-type coupling member may include a groove into which the magnet is inserted.

According to another aspect of the present invention, there is provided a cover for a recessed lighting apparatus including: a plurality of profiles each formed to include at least one diffuser plate insertion groove into which a diffuser plate is inserted, and at least one magnet insertion groove into which a magnet is inserted, wherein each profile is formed to have a coupling part formed at an end thereof and is attachable to, and detachable from, a metal housing through magnetic force, the coupling part forming a connection between adjacent profiles in an insertion-engagement manner, and the metal housing being fixed to a ceiling and formed to receive a lighting device therein.

One end of the profile may be formed to have a protrusion and the other end thereof may be formed to have a recessed groove.

According to another aspect of the present invention, there is provided a recessed lighting apparatus including: a lighting device; a metal housing formed to receive the lighting device therein and configured to be recessed and fixed in a fixed structure; a plurality of profiles, each including a first insertion groove having a coupling member inserted thereinto, a second insertion groove connected to the first insertion groove and formed to have a screw inserted thereinto, and a holding plate formed to have a diffuser plate stably mounted thereon; and an L-shaped coupling member including a body part and a wing part configured to be connected to the body part, inserted into the first insertion groove to be combined with the profile adjacent thereto using a screw, and a lever configured to be separable from the metal housing, the plurality of profiles and the L-shaped coupling member being configured to receive the diffuser plate therein and configured to be separable from the metal housing.

According to another aspect of the present invention, there is provided a recessed lighting apparatus, including: a lighting device; a metal housing formed to receive the lighting device therein and configured to be recessed in and fixed to a fixed structure; a plurality of profiles having at least one diffuser plate insertion groove formed to have a diffuser plate inserted thereinto, and at least one magnet insertion groove formed to have a magnet inserted thereinto, the profile being formed to have a coupling part formed at an end thereof, and to be attachable to, and detachable from, the metal housing through magnetic force.

BRIEF DESCRIPTION OF DRAWINGS

The above and other aspects, features and other advantages of the present invention will be more clearly understood from the following detailed description taken in conjunction with the accompanying drawings, in which.

DETAILED DESCRIPTION OF PREFERRED EMBODIMENT

Figure 1:
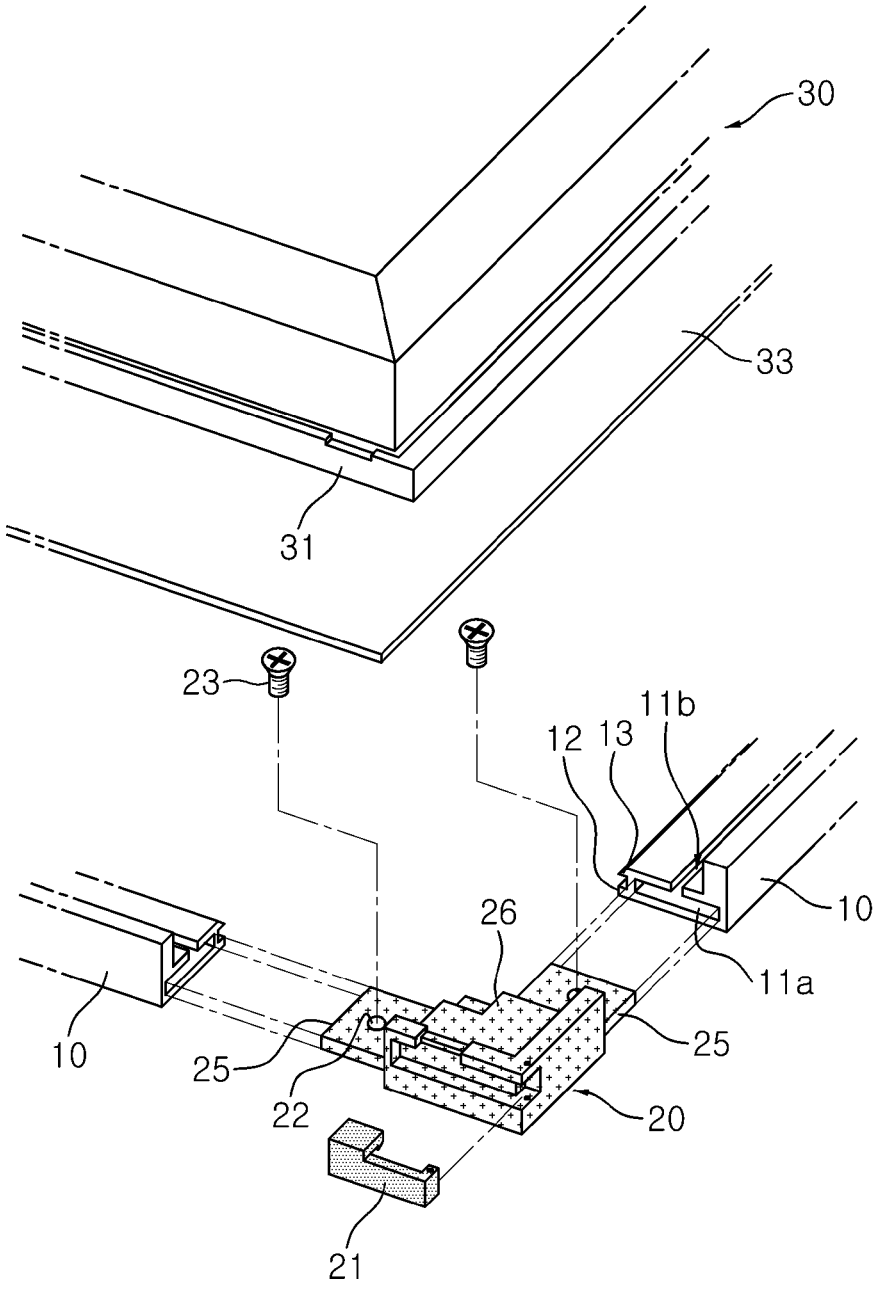
FIG. 1 is an exploded perspective view of a cover for a recessed lighting apparatus according to an embodiment of the present invention.

Exemplary embodiments of the present invention will now be described in detail with reference to the accompanying drawings such that they could be easily practiced by those having skill in the art to which the present invention pertains. However, in describing the exemplary embodiments of the present invention, detailed descriptions of well-known functions or constructions will be omitted so as not to obscure the description of the present invention with unnecessary detail.

In addition, like reference numerals denote like elements throughout the drawings.

Unless explicitly described to the contrary, the word "comprise" and variations thereof such as "comprises" or "comprising," will be understood to imply the inclusion of stated elements but not the exclusion of any other elements.

FIG. 1 is an exploded perspective view of a recessed lighting apparatus including a cover for a recessed lighting apparatus according to an embodiment of the present invention. A coupling structure between adjacent profiles 10 shown in FIG. 1 will be equally applied to those between other adjacent profiles. In addition, the structures in respective profiles 10 are approximately equal to one other, and thus, a description for a structure of only one profile will be sufficient herein.

Referring to FIG. 1, a recessed lighting apparatus may include a lighting device, a metal housing configured to receive the lighting device therein, a diffuser plate and a cover for a recessed lighting apparatus. The cover for a recessed lighting apparatus may include a plurality of profiles 10 and an L-shaped coupling member 20.

The profile 10 may be configured to be fixed to a ceiling, a wall, or the like, and to surround a frame 31 of the metal housing 30 that is configured to receive a lighting device (not shown) such as a fluorescent lamp or the like, therein. The profile 10 provided to be formed in a quadrangularly-shaped frame may be formed by injection molding aluminum in a lengthwise direction to be elongated and then cutting the injection-molded aluminum in predetermined lengths. A center portion in a lengthwise direction of the aluminum may be formed to have an open portion to form a first insertion groove 11*a* into which the coupling member 20 is inserted.

A second insertion groove 11*b* may be formed in an upper part of the first insertion groove 11*a* and formed to be connected to the first insertion groove 11*a*. The second insertion groove 11*b* may be provided as a portion in which a screw is inserted into a screw hole 22 formed in the L-shaped coupling member 20 that is inserted into the first insertion groove 11*a*, so as to allow a combination of the L-shaped coupling member 20 and the profile 10.

A holding plate 12, in which a diffuser plate 33 is stably mounted, may be formed to protrude from an inner portion of the profile 10. At an upper position of a predetermined height from the holding plate 12, a holding jaw 13 may be further formed such that the diffuser plate 33, stably mounted on the holding plate 12, may closely adhere to the profile.

The L-shaped coupling member 20 may include a body part 26, a wing part 25 coupled to the body part 26, and a lever 21. The wing part 25 may be inserted into the first insertion groove 11*a* formed at an end of the profile 10 so as to be connected to an adjacent profile 10. The screw hole 22 may be formed in the wing part 25. A fastening screw 23 may be inserted into the screw hole 22 to combine the L-shaped coupling member 20 and the profile 10.

The lever 21 may be provided in an outer part of the body part 26. A head part of the lever 21 may be fixed to the frame 31 of the metal housing 30 such that the profile 10 may be fixed to the metal housing 30 through the L-shaped coupling member 20, that is, the cover for a recessed lighting apparatus may be fixed thereto.

In order to increase a combinational force between the L-shaped coupling member 20 and the metal housing 30, a magnet insertion groove (not shown) may be further formed in the body part 26, into which a magnet is inserted.

Figure 2A:
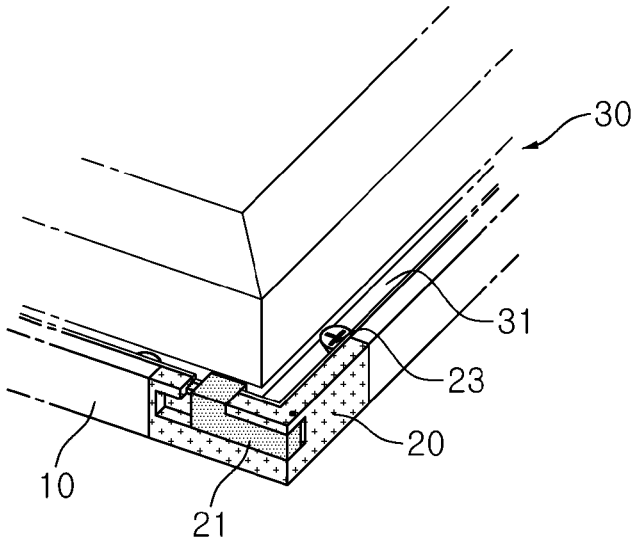
FIGS. 2A and 2B illustrate a figure in which a lever is provided with an L-shaped coupling member and configured to be attachable to, and detachable from, a frame of a metal housing according to the embodiment of the present invention.
Figure 2B:
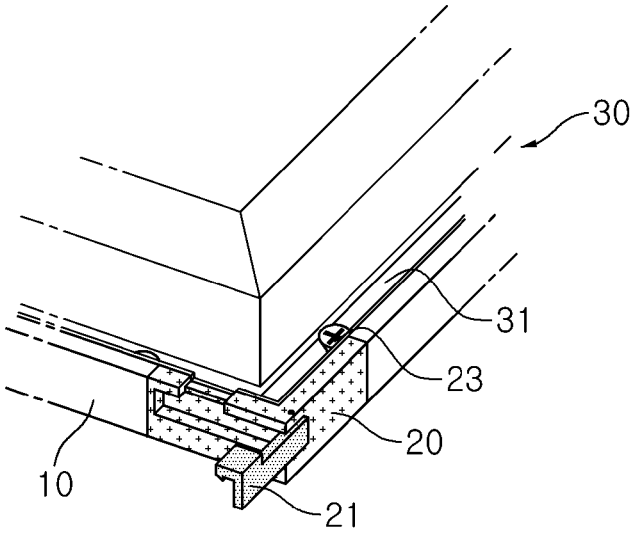

FIGS. 2A and 2B illustrate a figure in which the lever 21 is provided to the L-shaped coupling member 20 to be attachable to, and detachable from, the frame 31 of the metal housing 30, according to the embodiment of the present invention. A screw hole into which the fastening screw 23 is inserted may be formed in the frame 31 of the metal housing 30 in order to improve a combinational force between the metal housing 30 and the profile 10 by using the fastening screw 23.

Figure 3:
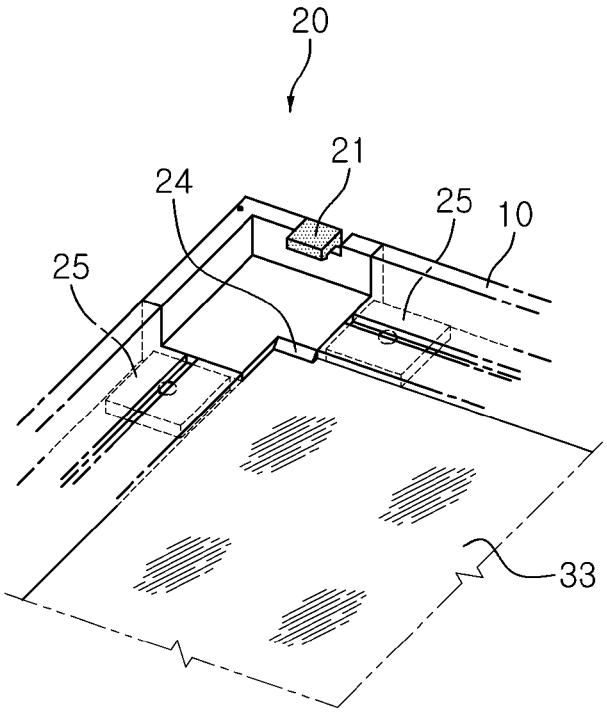
FIG. 3 is a perspective view showing mutually adjacent profiles, an L-shaped coupling member combined with the profiles, and a diffuser plate that is supported by and fixed to the L-shaped coupling member according to the embodiment of the present invention.

FIG. 3 is a perspective view showing adjacent profiles, an L-shaped coupling member combined therewith, and a diffuser plate that is supported by and fixed to the L-shaped coupling member according to the embodiment of the present invention.

Referring to FIG. 3, the diffuser plate 33 may be stably mounted on the holding plate 12 formed with the profile 10, and therefore, be fixed to the profile 10 and the L-shaped coupling member 20 by being held by the holding jaw 24 formed in the L-shaped coupling member 20.

When the length of the profile 10 is shorter than that of a side of the metal housing 30, a straight-type coupling member 40 may be used to connect the profiles 10 provided to surround the same side of the metal housing 30.

Figure 4A:
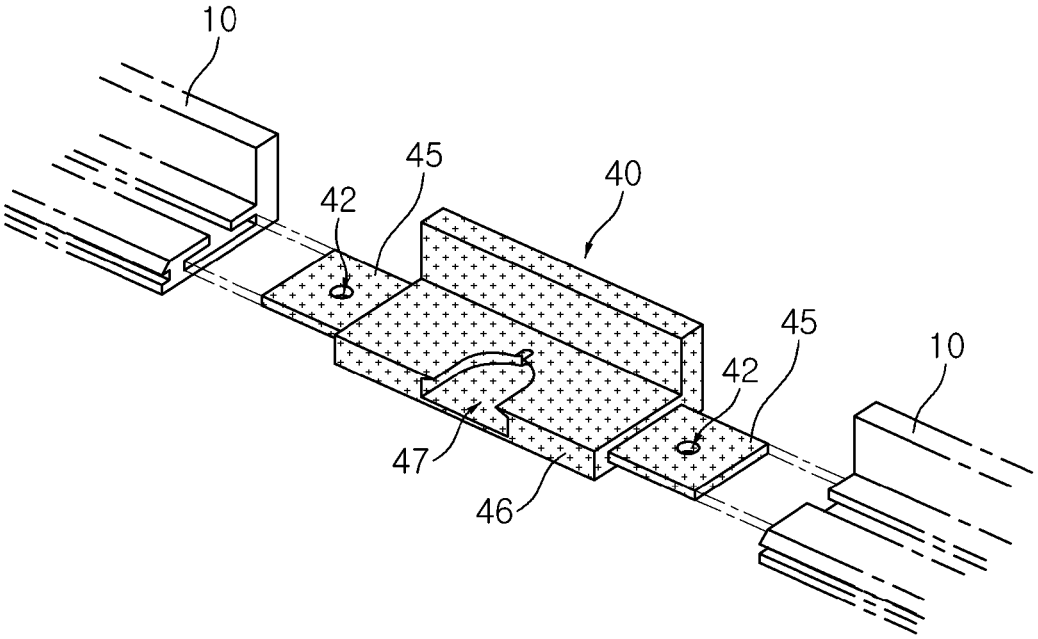
FIG. 4A is a perspective view of a straight-type coupling member connecting the profiles according to the embodiment of the present invention.

FIG. 4A is a perspective view of a straight-type coupling member 40 connecting the profiles 10 according to the embodiment of the present invention. The straight-type coupling member 40 may be configured to include a body part 46 and two wing parts 45. A magnet insertion groove 47 into which a magnet is inserted may be formed in the body part 46. The profile 10, combined with the straight-type coupling member 40 and the diffuser plate 33, may adhere to the metal housing 30 by using the straight-type coupling member 40 into which a magnet 44 has been inserted.

Figure 4B:
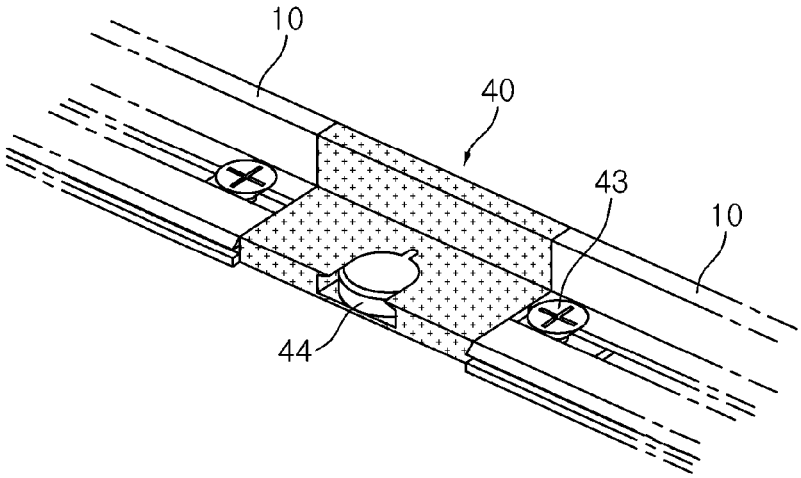
FIG. 4B shows a figure in which the straight-type coupling member is combined with the profiles provided to the left and right thereof by using fastening screws according to the embodiment of the present invention.

A screw hole 42 may be formed in each of the wing parts 45. The wing parts 45 may be respectively inserted into the first insertion grooves formed in the profiles 10 and respectively combined with both of the profiles 10 by inserting a fastening screw into the screw hole 42 formed in each of the wing parts 45. FIG. 4B shows a figure in which the straight-type coupling member 40 is combined with the profiles 10 provided at the left and right thereof by using fastening screws 43 according to the embodiment of the present invention. As shown in FIG. 4B, the magnet 44 is inserted into the magnet groove 47 formed in the body part 46.

Figure 5:
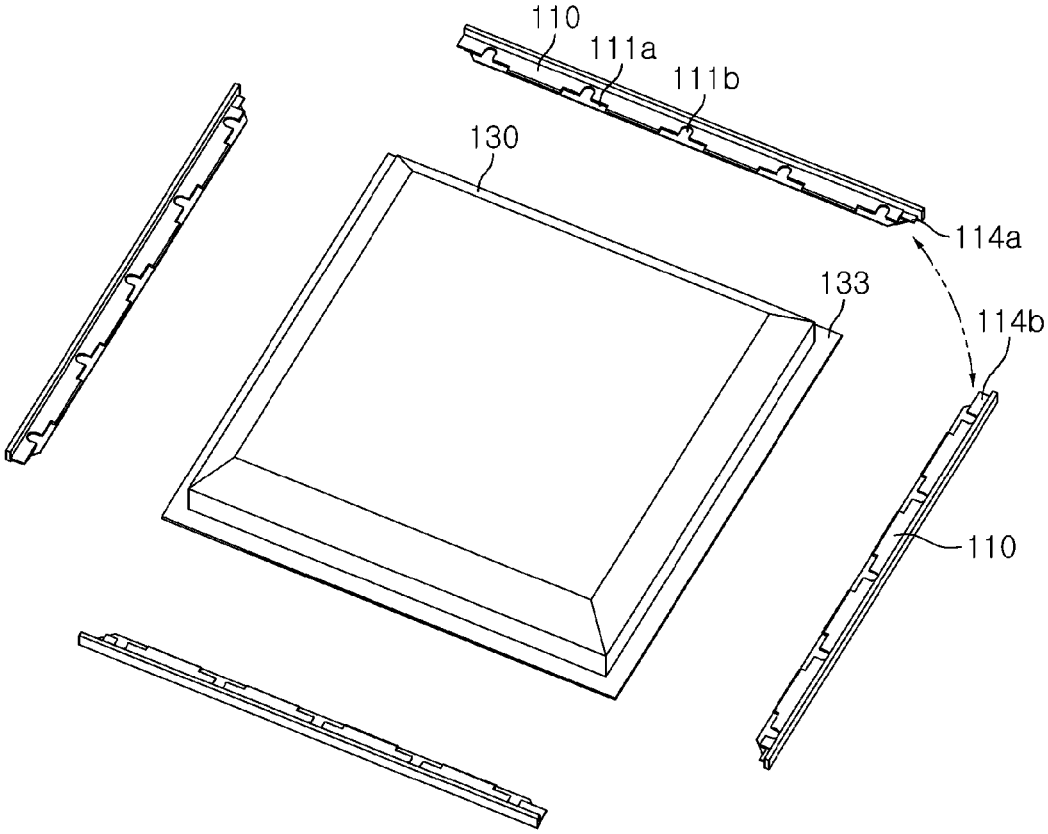
FIG. 5 is an exploded perspective view illustrating a metal housing, a diffuser plate and a plurality of profiles according to another embodiment of the present invention.

FIG. 5 is an exploded perspective view of a recessed lighting apparatus including a cover for a recessed lighting apparatus according to another embodiment of the present invention. The recessed lighting apparatus may be configured to include a lighting device, a metal housing formed to receive the lighting device therein, a diffuser plate and a cover for a recessed lighting apparatus. The cover for a recessed lighting apparatus may be configured to include a plurality of profiles.

The metal housing 130 may be installed to be fixed to a fixed structure, for example, a ceiling, a wall, or the like, and formed to receive a lighting device (not shown) such as an LED (a Light Emitting Device), a fluorescent lamp, or the like. The metal housing 130 may be formed of a ferromagnetic substance such as iron, nickel or cobalt, or a paramagnetic substance such as tungsten, aluminum, or the like, but may preferably be formed of a ferromagnetic substance in order to maintain a strong combinational force with the profiles 110 using magnetic force.

The profile 110 may be configured to closely adhere to the metal housing 130 while being configured to correspond to the frame of the metal housing 130. The profile 110 may be formed to include at least one diffuser plate insertion groove 111*a* into which a diffuser plate 133 is inserted, and at least one magnet insertion groove 111*b* into which a magnet is inserted, but may preferably include a plurality of grooves.

The profiles 110 may be configured to closely adhere to the metal housing 130 by inserting the magnet thereof into the magnet insertion groove 111*b* formed in the profile 110, by using magnetic force.

The profile 110 may be formed to have a coupling part formed at an end thereof, the coupling part undergoing a combination in an insertion-engagement manner and being formed to be connected to an adjacent profile 110 without a separate coupling member. As an example of the coupling part, one end of the profile 110 may be formed to have a protrusion 114*a* and the other end thereof may be formed to have a recessed groove 114*b*.

The diffuser plate 133 may actually have the same shape as an opening of a combined profile (110) assembly. The diffuser plate 133 may be manufactured of a material such as a transparent polycarbonate.

As set forth above, in a cover for a recessed lighting apparatus according to an embodiment of the present invention, an excellent combinational force with a metal housing may be provided to reduce danger in the case that the cover for a lighting apparatus falls therefrom, and an attachment thereof to, or a detachment from, the metal housing may be relatively easy and the size thereof may be facilitated to be controlled depending on the size of the metal housing. In addition, a diffuser plate can be stably fixed.

While the present invention has been shown and described in connection with the exemplary embodiments, it will be apparent to those skilled in the art that modifications and variations can be made without departing from the spirit and scope of the invention as defined by the appended claims.

What is claimed is:

1. A cover for a recessed lighting apparatus, comprising:

a plurality of profiles, each including a first insertion groove having a coupling member inserted thereinto, a second insertion groove connected to the first insertion groove and formed to have a screw inserted thereinto, and a holding plate formed to have a diffuser plate stably mounted thereon; and an L-shaped coupling member including a body part and a wing part configured to be connected to the body part, inserted into the first insertion groove to be combined with a profile adjacent thereto using a screw, and a lever configured to be separable from a recessed metal housing formed to receive a lighting device therein, the plurality of profiles and the L-shaped coupling member being configured to receive the diffuser plate therein and configured to be separable from the metal housing.

2. The cover of claim 1, wherein the profile includes a holding jaw to which the diffuser plate is fixed.

3. The cover of claim 1, wherein the L-shaped coupling member includes a holding jaw to which the diffuser plate is fixed.

4. The cover of claim 1, further comprising a straight-type coupling member connecting profiles forming a common side of the cover for a recessed lighting apparatus.

5. The cover of claim 4, wherein the straight-type coupling member includes a groove into which a magnet is inserted.

6. A cover for a recessed lighting apparatus, comprising:

a plurality of profiles each formed to include at least one diffuser plate insertion groove into which a diffuser plate is inserted, and at least one magnet insertion groove into which a magnet is inserted, each profile being formed to have a coupling part formed at an end thereof, and attachable to, and detachable from, a metal housing through magnetic force, the coupling part forming a combination between adjacent profiles in an insertion-engagement manner, and the metal housing being fixed to a ceiling and formed to receive a lighting device therein.

7. The cover of claim 6, wherein one end of the profile is formed to have a protrusion and the other end thereof is formed to have a recessed groove.

8. A recessed lighting apparatus comprising:

a lighting device;

a metal housing formed to receive the lighting device therein and configured to be recessed and fixed in a fixed structure;

a plurality of profiles, each including a first insertion groove having a coupling member inserted thereinto, a second insertion groove connected to the first insertion groove and formed to have a screw inserted thereinto, and a holding plate formed to have a diffuser plate stably mounted thereon; and an L-shaped coupling member including a body part and a wing part configured to be connected to the body part, inserted into the first insertion groove to be combined with the profile adjacent thereto using a screw, and a lever configured to be separable from the metal housing, the plurality of profiles and the L-shaped coupling member being configured to receive the diffuser plate therein and configured to be separable from the metal housing.

9. A recessed lighting apparatus, comprising:

a lighting device;

a metal housing formed to receive the lighting device therein and configured to be recessed in and fixed to a fixed structure;

a plurality of profiles having at least one diffuser plate insertion groove formed to have a diffuser plate inserted thereinto, and at least one magnet insertion groove formed to have a magnet inserted thereinto, the profile being formed to have a coupling part formed at an end thereof, and to be attachable to, and detachable from, the metal housing through magnetic force.

* * * * *